US008289260B2

(12) United States Patent
Kim et al.

(10) Patent No.: US 8,289,260 B2
(45) Date of Patent: Oct. 16, 2012

(54) DRIVING DEVICE, DISPLAY DEVICE, AND METHOD OF DRIVING THE SAME

(75) Inventors: Cheol-Min Kim, Seoul (KR); Il-Gon Kim, Seoul (KR); Tae-Hyeong Park, Yongin-si (KR); Gi-Chang Lee, Seoul (KR); Oh-Kyong Kwon, Seoul (KR)

(73) Assignees: Samsung Electronics Co., Ltd. (KR); Industry-University Cooperation Foundation, Hanyang University (KR)

( * ) Notice: Subject to any disclaimer, the term of this patent is extended or adjusted under 35 U.S.C. 154(b) by 815 days.

(21) Appl. No.: 11/623,398

(22) Filed: Jan. 16, 2007

(65) Prior Publication Data

US 2007/0171177 A1 Jul. 26, 2007

(30) Foreign Application Priority Data

Jan. 20, 2006 (KR) ..... 10-2006-0006521

(51) Int. Cl.
*G09G 3/36* (2006.01)

(52) U.S. Cl. ..... 345/100

(58) Field of Classification Search ..... 345/100, 345/98, 690

See application file for complete search history.

(56) References Cited

U.S. PATENT DOCUMENTS 5,363,118 A * 11/1994 Okumura ..... 345/95
6,181,314 B1 1/2001 Nakajima et al.
6,331,847 B1 12/2001 Kim et al.
6,392,629 B1 5/2002 Murakami et al.
6,570,560 B2 * 5/2003 Hashimoto ..... 345/211
6,747,626 B2 6/2004 Chiang
6,756,962 B1 6/2004 Akimoto et al.
6,909,414 B2 6/2005 Tsuchi et al.
2001/0013851 A1 * 8/2001 Hashimoto et al. ..... 345/91
2004/0085115 A1 5/2004 Fujiyoshi et al.
2005/0062734 A1 3/2005 Morita
2005/0140625 A1 6/2005 Kim et al.

(Continued)

FOREIGN PATENT DOCUMENTS

CN 1610933 4/2005

(Continued)

OTHER PUBLICATIONS

European Search Report in regards to Application No./ Patent No. 07000852.9-2205/1811488; Dated : Aug. 28, 2008.

*Primary Examiner* — Chanh Nguyen
*Assistant Examiner* — Tsegaye Seyoum
(74) *Attorney, Agent, or Firm* — Cantor Colburn LLP

(57) ABSTRACT

A driving device for a display device includes a gray voltage generator generating a plurality of gray voltages, a voltage selector selecting an output voltage from the plurality of gray voltages, a voltage level converter converting a level of the output voltage selected by the voltage selector and applying the output voltage with a converted level to data lines, a first switching unit connecting the voltage level converter to the voltage selector and the data lines, and a second switching unit directly connecting the voltage selector and the data lines. Operating times of the first and second switching units are different. Accordingly, when a data voltage is charged in or discharged from a data line, since a separate discharging transistor or a separate discharging amplifier is not used, power consumption and an area of a data driver are reduced.

27 Claims, 6 Drawing Sheets

U.S. PATENT DOCUMENTS

| | | | | |
|---|---|---|---|---|
| 2005/0195652 | A1* | 9/2005 | Maki | 365/185.11 |
| 2006/0033694 | A1* | 2/2006 | Maki | 345/89 |

FOREIGN PATENT DOCUMENTS

| | | | |
|---|---|---|---|
| EP | 1 551 004 | A2 | 7/2005 |
| GB | 2 362 277 | A | 11/2001 |
| JP | 2000200069 | | 7/2000 |
| JP | 2001228829 | | 8/2001 |
| JP | 2002215108 | | 7/2002 |
| JP | 2004029703 | | 1/2004 |
| JP | 2004166039 | | 6/2004 |
| JP | 2005121911 | | 5/2005 |
| JP | 2005122214 | | 5/2005 |
| JP | 2005242215 | | 9/2005 |
| KR | 10-0348539 | | 7/2002 |
| KR | 1020040064327 | | 7/2004 |
| KR | 1020050068839 | | 7/2005 |
| KR | 1020050097036 | | 10/2005 |
| KR | 1020050097039 | | 10/2005 |
| KR | 10-0557501 | | 2/2006 |
| KR | 1020060027169 | | 3/2006 |

* cited by examiner

| Power Consumption(mW) | | |
|---|---|---|
| | Comparative Example | Embodiment |
| Gray Voltage Generator | 2.129 | 3.799 |
| Buffer | 7.240 | 0.388 |
| Total Sum | 9.936 | 4.187 |

DRIVING DEVICE, DISPLAY DEVICE, AND METHOD OF DRIVING THE SAME

This application claims priority to Korean Patent Application No. 10-2006-0006521, filed on Jan. 20, 2006 and all the benefits accruing therefrom under 35 U.S.C. §119, and the contents of which in its entirety are herein incorporated by reference.

BACKGROUND OF THE INVENTION (a) Field of the Invention

The present invention relates to a data driver, a display device having the data driver, and a method of driving the display device. More particularly, the present invention relates to a data driver having reduced power consumption and area, a display device having the data driver, and a method of driving the display device.

(b) Description of the Related Art

In recent years, as personal computers, televisions, and the like have been required to have a light weight and a small size, display devices have also been required to have the same features. In order to meet these requirements, flat panel displays have been substituted for cathode ray tubes ("CRTs").

Examples of the flat panel displays may include a liquid crystal display ("LCD"), a field emission display ("FED"), an organic light emitting display ("OLED"), a plasma display panel ("PDP"), and the like.

Generally, in an active matrix flat panel display, a plurality of pixels are disposed in a matrix, and images are displayed by controlling the optical strength of each pixel according to given luminance information. Among flat panel displays, an LCD includes two display panels on which pixel electrodes and a common electrode are provided, and a liquid crystal layer that is interposed between the two display panels and has dielectric anisotropy. In the LCD, an electric field is applied to the liquid crystal layer, and the intensity of the electric field is controlled so as to control transmittance of light passing through the liquid crystal layer, thereby obtaining desired images.

BRIEF SUMMARY OF THE INVENTION

Exemplary embodiments of the present invention provide a driving device for a display device, the display device having a plurality of pixels connected to data lines. The driving device includes a gray voltage generator generating a plurality of gray voltages, a voltage selector selecting an output voltage from the plurality of gray voltages, a voltage level converter converting a level of the output voltage selected by the voltage selector and applying the output voltage with the converted level to the data lines, a first switching unit connecting the voltage level converter to the voltage selector and the data lines, and a second switching unit directly connecting the voltage selector and the data lines. Further, operating times of the first switching unit and the second switching unit are different from each other.

The voltage selector may determine the output voltage based on input image data. The voltage selector may include a digital-to-analog converter.

The second switching unit may include a transistor that has input and output terminals connected to the voltage selector and at least one of the data lines. The transistor of the second switching unit may be a direct switching transistor with the input terminal connected to an output terminal of the voltage selected and the output terminal of the direct switching transistor connected to the at least one of the data lines.

The first switching unit may include a first switching transistor connecting the voltage level converter to the voltage selector, and a second switching transistor connecting the voltage level converter to the data lines.

The voltage level converter may have a driving transistor including a control terminal, an input terminal, and an output terminal, the control terminal of the driving transistor may be electrically connected to the first switching transistor, and the output terminal of the driving transistor is connected to the second switching transistor. The first switching unit may further include a third switching transistor connecting the input terminal of the driving transistor to a first voltage terminal having a first voltage. The voltage level converter may further include a bias transistor connected between the output terminal of the driving transistor, and a second voltage terminal having a second voltage that is smaller than the first voltage.

The driving device of a display device may include a threshold voltage compensating unit compensating a threshold voltage of the driving transistor. The threshold voltage compensating unit may operate when the first switching unit is turned off. The second switching unit may be turned on during operation of the threshold voltage compensating unit, and operation of the threshold voltage compensating unit need not affect charging and discharging of the data lines. The threshold voltage compensating unit may include a capacitor connected between the control terminal of the driving transistor and the first switching transistor, a first compensating transistor connected to the input terminal of the driving transistor and a first voltage terminal having a first voltage, a second compensating transistor connected to the input terminal and the output terminal of the driving transistor, and a third compensating transistor connected between the capacitor and first switching transistor and the output terminal of the driving transistor. The operation of the threshold voltage compensating unit may be maintained for a time in which a voltage charged in the capacitor is stabilized.

The voltage level converter need not include an amplifier for applying the output voltage from the voltage selector to the data lines.

Other exemplary embodiments of the present invention provide a display device including a plurality of pixels connected to data lines, a gray voltage generator generating a plurality of gray voltages, a gate driver applying a gate signal to gate lines, and a data driver processing a voltage selected from the plurality of gray voltages, generating an output voltage, and applying the output voltage to the data lines. Further, the data driver has an output buffer charging and discharging the data lines according to the output voltage.

The data driver may further include a digital-to-analog converter converting digital image data into a data voltage selected from the gray voltages and supplying the voltage to the output buffer.

The output buffer may include a driving transistor processing the data voltage and outputting the processed data voltage as the output voltage, in a first period, and a first switching transistor directly connecting a voltage of the data voltage to a data line, in a second period that is different from the first period.

The output buffer may have a second switching transistor connecting a first voltage terminal having the first voltage to an input terminal of the driving transistor, in the first period, a third switching transistor electrically connecting a terminal of the data voltage to a control terminal of the driving transistor, in the first period, and a fourth switching transistor connecting an output terminal of the driving transistor to a data line, in the first period.

The output buffer further may include a capacitor charging a voltage between the control terminal and the output terminal of the driving transistor, in a third period that is different from the first period, a first compensating transistor connecting the first voltage terminal to the input terminal of the driving transistor, in the third period, a second compensating transistor connecting the input terminal and the control terminal of the driving transistor, in the third period, and a third compensating transistor connecting the capacitor and the output terminal of the driving transistor, in the third period.

The third switching transistor may connect the terminal of the data voltage to the control terminal of the driving transistor through the capacitor, in the first period.

The third period may be included in the second period. The output buffer may further include a bias transistor connected between the output terminal of the driving transistor and the second voltage and allows an output current of the driving transistor to flow in accordance with a bias voltage.

Yet other exemplary embodiments of the present invention provide a method of driving a display device including converting a digital image signal into an analog data voltage, connecting a terminal of the analog data voltage directly to data lines of the display device, generating a conversion voltage based on the analog data voltage, and connecting a terminal of the conversion voltage to the data lines.

Connecting the terminal of the data voltage directly to the data line may be performed before or after connecting the terminal of the conversion voltage to the data lines.

The conversion voltage may be generated by a driving transistor, and the method may further include compensating a threshold voltage of the driving transistor. Compensating the threshold voltage of the driving transistor may be performed in a state in which the terminal of the analog data voltage is directly connected to the data lines. The method of driving a display device may further include, before generating the conversion voltage, disconnecting the terminal between the analog data voltage and the data lines.

BRIEF DESCRIPTION OF THE DRAWINGS

The present invention will become more apparent by describing exemplary embodiments thereof with reference to the accompanying drawings, in which.

DETAILED DESCRIPTION OF THE INVENTION

Figure 1:
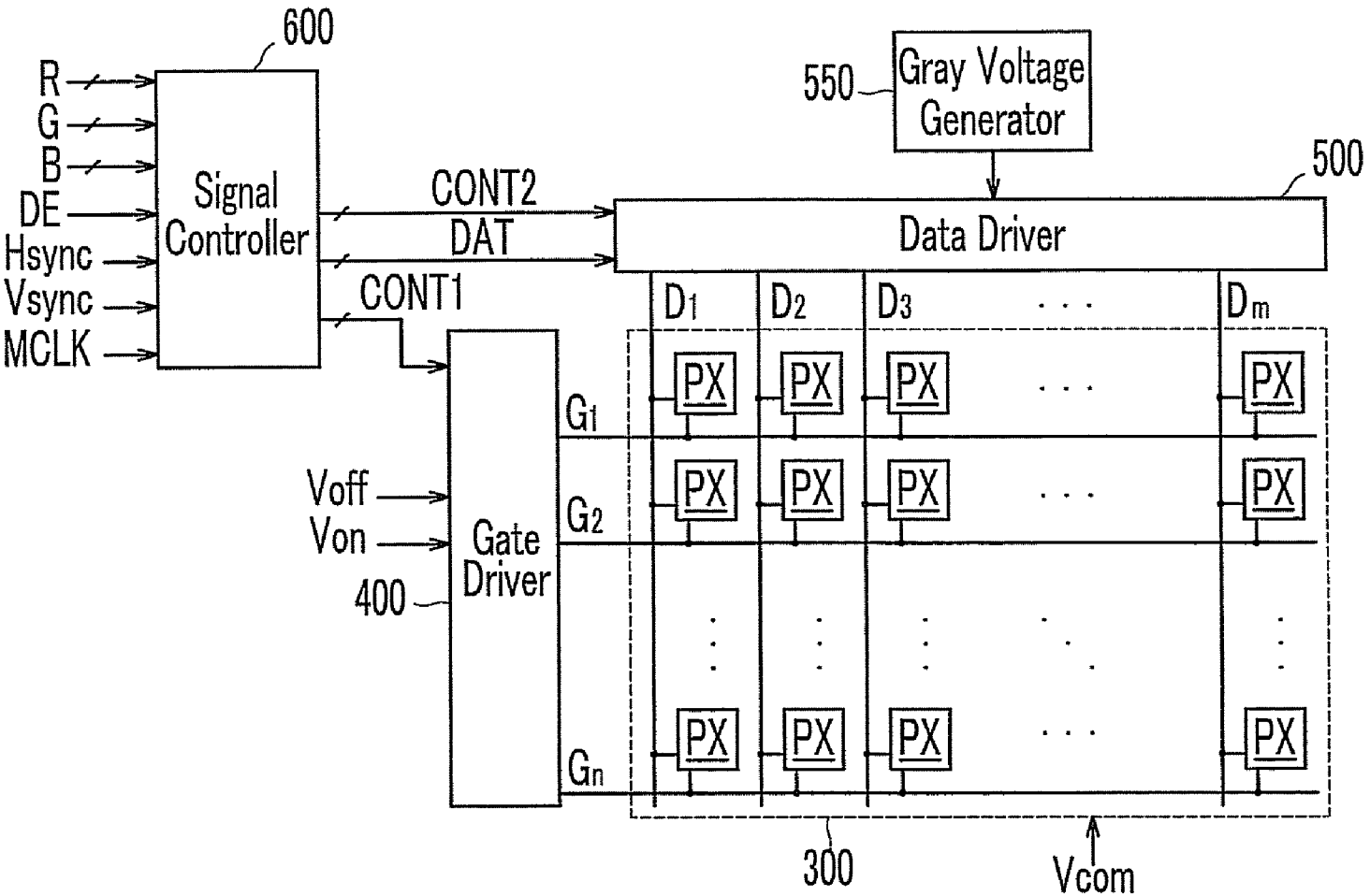
FIG. 1 is a block diagram of an exemplary liquid crystal display ("LCD") according to an exemplary embodiment of the present invention.

The present invention provides a driving device, a display device, and a method of driving a display device, having advantages of reducing both power consumption and an area of a data driver.

The present invention will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

A display device according to an exemplary embodiment of the present invention will be described with reference to the accompanying drawings.

Figure 2:
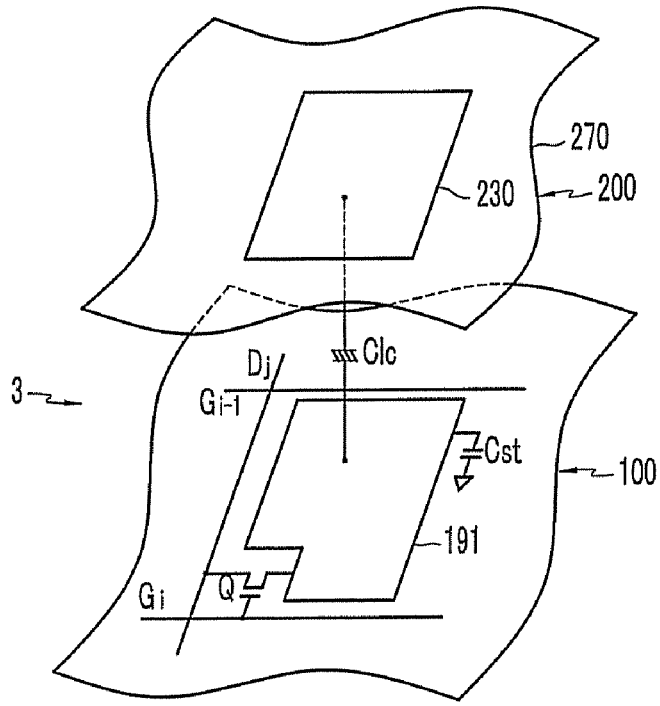
FIG. 2 is an equivalent circuit diagram of one exemplary pixel of an exemplary LCD according to an exemplary embodiment of the present invention.

FIG. 1 is a block diagram of an exemplary liquid crystal display ("LCD") according to an exemplary embodiment of the present invention, and FIG. 2 is an equivalent circuit diagram of one exemplary pixel of an exemplary LCD according to an exemplary embodiment of the present invention.

As shown in FIG. 1, an LCD according to an exemplary embodiment of the present invention includes a liquid crystal panel assembly 300, a gate driver 400 and a data driver 500 that are connected to the liquid crystal panel assembly 300, a gray voltage generator 550 that is connected to the data driver 500, and a signal controller 600 that controls the above-described elements.

As viewed in an equivalent circuit, the liquid crystal panel assembly 300 includes a plurality of signal lines $G_1$ to $G_n$ and $D_1$ to $D_m$, and a plurality of pixels PX that are connected to the plurality of signal lines $G_1$ to $G_n$ and $D_1$ to $D_m$ and disposed in a matrix. In FIG. 2, the liquid crystal panel assembly 300 includes lower and upper panels 100 and 200, sometimes referred to as a thin film transistor ("TFT") array panel and a common electrode or color filter panel, respectively, that face each other, and a liquid crystal layer 3 that is interposed between the lower and upper panels 100 and 200.

The signal lines $G_1$ to $G_n$ and $D_1$ to $D_m$ include a plurality of gate lines $G_1$ to $G_n$ that transmit gate signals (also referred to as "scanning signals"), and a plurality of data lines $D_1$ to $D_m$ that transmit data signals. The gate lines $G_1$ to $G_n$ extend in a row direction, a first direction, so as to be substantially parallel to one another, and the data lines $D_1$ to $D_m$ extend in a column direction, a second direction, so as to be substantially parallel to one another. The first direction may be substantially perpendicular to the second direction.

Each pixel PX, for example a pixel PX that is connected to an i-th (where i=1, 2, . . . , n) gate line $G_i$ and a j-th (where j=1, 2, . . . , m) data line Dj, includes a switching element Q that is connected to the signal lines $G_i$ and $D_j$, and a liquid crystal capacitor Clc and a storage capacitor Cst that are connected to the switching element Q. The storage capacitor Cst may be omitted, if necessary.

The switching element Q is a three-terminal element, such as a TFT, that is provided on the lower panel 100, and has a control terminal, such as a gate electrode, connected to a gate line $G_i$, an input terminal, such as a source electrode, connected to a data line $D_j$, and an output terminal, such as a drain electrode, connected to the liquid crystal capacitor Clc and the storage capacitor Cst.

The liquid crystal capacitor Clc uses a pixel electrode 191 of the lower panel 100 and a common electrode 270 of the upper panel 200 as two terminals, and the liquid crystal layer 3 between the pixel electrode 191 and the common electrode 270 functions as a dielectric. The pixel electrode 191 is connected to the switching element Q, such as to the output terminal of the switching element Q, and the common electrode 270 is formed on an entire surface, or substantially an entire surface, of the upper panel 200 and applied with a common voltage Vcom. In an alternative embodiment, the common electrode 270 may be provided on the lower panel 100. In this case, at least one of the two electrodes 191 and 270 can be formed in a linear or a bar shape.

The storage capacitor Cst, which performs an auxiliary function of the liquid crystal capacitor Clc, has a separate signal line (not shown) and a pixel electrode 191 provided on the lower panel 100 to overlap each other with an insulator interposed there between. A fixed voltage, such as a common voltage Vcom, is applied to the separated signal line. Alternatively, the storage capacitor Cst may be formed by the pixel electrode 191 and the overlying previous gate line that are arranged to overlap each other through the insulator. In other alternative embodiments, the storage capacitor Cst may not be included in the LCD.

Meanwhile, for color display, each pixel PX uniquely displays one color in a set of colors, such as primary colors, (spatial division) or each pixel PX alternately displays the colors, such as three primary colors, (temporal division) as time lapses, and a desired color is recognized by a spatial and temporal sum of the three colors. The set of colors may include red, green, and blue, for example. FIG. 2 is an example of spatial division, and it illustrates a case in which each pixel PX has a color filter 230 for displaying one of the colors in a region of the upper panel 200 corresponding to the pixel electrode 191. In an alternative embodiment, the color filter 230 may be formed above or below the pixel electrode 191 of the lower panel 100.

At least one polarizer (not shown) for polarizing light is provided on an external surface of the liquid crystal panel assembly 300. For example, first and second polarized films may be disposed on the upper and lower panels 100, 200. The first and second polarized films may adjust a transmission direction of light externally provided into the upper and lower panels 100, 200 in accordance with an aligned direction of the liquid crystal layer. The first and second polarized films may have first and second polarized axes thereof substantially perpendicular to each other, respectively.

Referring back to FIG. 1, the gray voltage generator 550 generates two sets of gray voltages related to transmittance of the pixel PX (or a set of reference gray voltages).

One of the two sets of gray voltages has a positive value with respect to the common voltage Vcom, and the other has a negative value with respect to the common voltage Vcom.

The gate driver 400 is connected to the gate lines $G_1$ to $G_n$ of the liquid crystal panel assembly 300 and applies a gate signal composed of a combination of a gate-on voltage Von and a gate-off voltage Voff to the gate lines $G_1$ to $G_n$.

The data driver 500 is connected to the data lines $D_1$ to $D_m$ of the liquid crystal panel assembly 300, and it selects a gray voltage from the gray voltage generator 550 and applies it to the data lines $D_1$ to $D_m$ as a data voltage. The structure of the data driver 500 will be further described below.

The signal controller 600 controls the gate driver 400 and the data driver 500.

Each of the drivers 400, 500, 550, and 600 may be directly mounted on the liquid crystal panel assembly 300 in the form of at least one integrated circuit ("IC") chip, or mounted on a flexible printed circuit ("FPC") film (not shown) so as to be attached to the liquid crystal panel assembly 300 in the form of a tape carrier package ("TCP"), or mounted on a separate printed circuit board ("PCB") (not shown). Alternatively, each of the drivers 400, 500, 550, and 600 may be directly integrated with the liquid crystal panel assembly 300 together with the signal lines $G_1$ to $G_n$ and $D_1$ to $D_m$, and the switching elements Q, each of which is composed of a TFT. Further, each of the drivers 400, 500, 550, and 600 may be integrated in a single chip. In this case, at least one of the drivers 400, 500, 550, and 600 or at least one circuit that forms each of the drivers 400, 500, 550, and 600 may be disposed outside the single chip.

Hereinafter, operation of the liquid crystal panel assembly 300 in accordance with exemplary embodiments will be further described.

The signal controller 600 receives input image signals R, G and B and input control signals from an external graphics controller (not shown) for controlling display of the input image signals R, G, and B. The input image signals R, G, and B contain luminance information of each pixel PX, and the luminance has grays of a predetermined number, for example 1024 ($=2^{10}$), 256 ($=2^8$), or 64 ($=2^6$). Examples of the input control signals include a vertical synchronizing signal Vsync, a horizontal synchronizing signal Hsync, a main clock signal MCLK, a data enable signal DE, and the like.

The signal controller 600 appropriately processes the input image signals R, G, and B according to the operation conditions of the liquid crystal panel assembly 300 on the basis of the input image signals R, G, and B and the input control signals, and generates a gate control signal CONT1, a data control signal CONT2, and the like. Then, the signal controller 600 transmits the gate control signal CONT1 to the gate driver 400, and outputs the data control signal CONT2 and the processed image signal DAT to the data driver 500.

The gate control signal CONT1 includes a scanning start signal STV that instructs a scanning start operation and at least one clock signal that controls an output cycle of the gate-on voltage Von. The gate control signal CONT1 may further include an output enable signal OE that defines a duration time of the gate-on voltage Von.

The data control signal CONT2 includes a horizontal synchronization start signal STH that instructs a transmission start operation of digital image signals DAT for one row of pixels PX, a load signal LOAD that instructs application of an analog data voltage to the data lines $D_1$ to $D_m$, and a data clock signal HCLK. The data control signal CONT2 may further include an inversion signal RVS that inverts a voltage polarity of an analog data voltage for the common voltage Vcom (hereinafter, "a voltage polarity of an analog data voltage for the common voltage" is simply referred to as polarity of "a data voltage").

In accordance with the data control signal CONT2 supplied by the signal controller 600, the data driver 500 receives digital image signals DAT for one row of pixels PX, selects gray voltages corresponding to the respective digital image signals DAT, and converts the digital image signals DAT into an analog data voltage and applies it to the corresponding data lines $D_1$ to $D_m$.

In accordance with the gate control signal CONT1 supplied by the signal controller 600, the gate driver 400 applies the gate-on voltage Von to the gate lines $G_1$ to $G_n$, and turns on switching elements Q that are connected to the gate lines $G_1$ to $G_n$. Then, the data voltage supplied to the data lines $D_1$ to $D_m$ is applied to the corresponding pixels PX through the switching elements Q that are turned on.

The difference between the common voltage Vcom applied to the common electrode 270 and the data voltage applied to the pixel PX is represented as a charging voltage of the liquid crystal capacitor Clc, which is referred to as a pixel voltage. Liquid crystal molecules have different arrangements in accordance with the magnitude of the pixel voltage, so that the polarization of light passing through the liquid crystal layer 3 varies. The variation of the polarization causes a variation in the transmittance of light by a polarizer or a pair of polarizers attached to the LCD panel assembly 300. The pixel PX displays luminance indicated by a gray of the image signal DAT.

By repeating the above-mentioned processes while using one horizontal period (referred as "1H", equal to one period of the horizontal synchronizing signal Hsync and the data enable signal DE) as a unit, the gate-on voltage Von is sequentially applied to all the gate lines $G_1$ to $G_n$, and a data voltage is applied to all the pixel PX via the data lines $D_1$ to $D_m$, thereby displaying images of one frame.

After one frame is completed, the next frame starts, and an inversion signal RVS applied to the data driver 500 is controlled such that a polarity of a data voltage applied to each pixel PX is opposite to that of the previous frame ("frame inversion"). At this time, in one frame, a polarity of a data voltage flowing through one data line is changed according to characteristics of the inversion signal RVS (for example: row inversion and dot inversion), or polarities of data voltages applied to one row of pixels may be different (for example, column inversion and dot inversion).

Hereinafter, referring to FIG. 3, an exemplary data driver will be further described.

Figure 3:
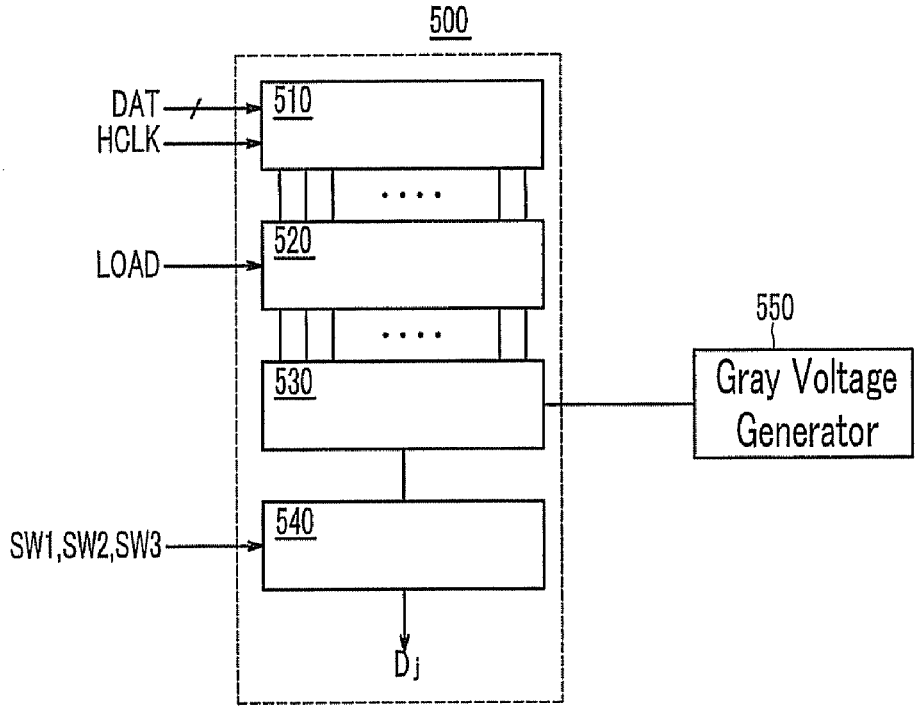
FIG. 3 is a block diagram of an exemplary data driver of an exemplary liquid crystal panel according to an exemplary embodiment of the present invention.

FIG. 3 is a block diagram of an exemplary data driver of an exemplary LCD according to an exemplary embodiment of the present invention.

The data driver 500 has at least one data driver IC that is connected to each of the data lines $D_1$ to $D_m$.

The data driver IC has a shift register 510, a latch 520, a digital-to-analog converter 530, and an output buffer 540 that are sequentially connected to one another.

If a horizontal synchronization start signal STH (or a shift clock signal) is input to the shift register 510, the shift register 510 transmits image data DAT to the latch 520 in accordance with a data clock signal (HCLK). In a case in which the data driver 500 has a plurality of data driver ICs, a shift register 510 of one data driver IC outputs a shift clock signal to a shift register of the next data driver IC.

The latch 520 stores the image data DAT, and outputs the image data DAT to a digital-to-analog converter 530 in accordance with a load signal LOAD The digital-to-analog converter 530 receives a gray voltage from the gray voltage generator 550, converts the digital image data DAT into an analog voltage, and outputs it to an output buffer 540.

The output buffer 540 outputs a voltage that is output by the digital-to-analog converter 530 to a corresponding data line $D_j$ as a data voltage, and maintains the voltage for one horizontal period 1H.

Hereinafter, the output buffer 540 will be further described with reference to FIGS. 4 to 6D.

Figure 4:
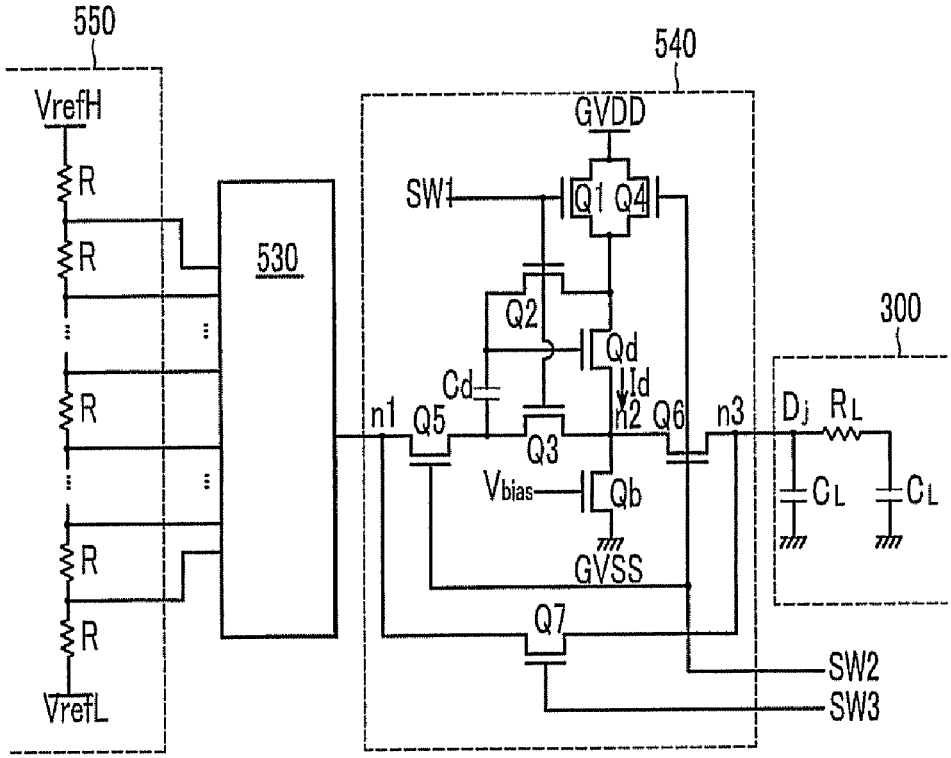
FIG. 4 is a detailed view of an exemplary output buffer of an exemplary data driver of FIG. 3.

FIG. 4 is a detailed circuit diagram of the exemplary output buffer of the exemplary data driver of FIG. 3.

Referring to FIG. 4, the output buffer 540 according to an exemplary embodiment of the present invention is formed between the digital-to-analog converter 530 and the data line $D_j$ of the liquid crystal panel assembly 300.

The gray voltage generator 550 has a plurality of resistors R that are connected in series to a voltage of a high-level gray reference voltage VrefH and a voltage of a low-level gray reference voltage VrefL. A voltage at nodes between the resistors R is output as a gray voltage to the digital-to-analog converter 530.

The digital-to-analog converter 530 includes a decoder (not shown) formed by a plurality of switching elements that select one of the gray voltages received from the gray voltage generator 550 in accordance with one image data DAT supplied by the latch 520.

The data line $D_j$ within the liquid crystal panel assembly 300 can be shown by a line resistance $R_L$ and a parasitic capacitor $C_L$ that charges a data voltage Vdat.

The output buffer 540 includes a driving transistor Qd, a plurality of switching transistors Q1 to Q7, a bias transistor Qb, and a capacitor Cd.

The driving transistor Qd has a control terminal, an input terminal, and an output terminal. The driving transistor Qd is an amplifying transistor that operates in a saturation region, and allows an output current Id corresponding to a voltage applied to the control terminal of the driving transistor Qd to flow through the output terminal of the driving transistor Qd.

The bias transistor Qb is provided such that the driving transistor Qd can cause an output current Id to flow.

The bias transistor Qb has a control terminal connected to a terminal of a bias voltage Vbias, an input terminal connected to an output terminal of the driving transistor Qd, and an output terminal connected to a terminal of the second voltage GVSS. The bias transistor Qb operates in a saturation region, and serves as a current source (current sink) that allows the output current Id of the driving transistor Qd and a charge of the data line $D_j$ to flow into the terminal of the second voltage GVSS.

Switching transistors Q1, Q2, and Q3 are compensating switching transistors of the output buffer 540. The capacitor Cd and the first to third compensating switching transistors Q1, Q2, and Q3 compensate a threshold voltage Vth of the driving transistor Qd.

The first compensating switching transistor Q1 has a control terminal connected to a terminal of the first switching signal SW1, an input terminal connected to a terminal of the first voltage GVDD; and an output terminal connected to the input terminal of the driving transistor Qd. The first compensating switching transistor Q1 transmits the first voltage GVDD to the input terminal of the driving transistor Qd according to the first switching signal SW1 applied to the control terminal of the first compensating switching transistor Q1.

The second compensating switching transistor Q2 has a control terminal connected to the terminal of the first switching signal SW1, an input terminal connected to the input terminal of the driving transistor Qd, and an output terminal connected to the control terminal of the driving transistor Qd. The second compensating switching transistor Q2 short-circuits an input terminal and an output terminal of the driving transistor Qd according to the first switching signal SW1, and makes the driving transistor Qd diode-connected.

The third compensating switching transistor Q3 has a control terminal connected to the terminal of the first switching signal SW1, an input terminal connected to the output terminal of the driving transistor Qd, and an output terminal connected to the capacitor Cd. The third compensating switching transistor Q3 connects an output terminal of the driving transistor Qd to a capacitor Cd in accordance with the first switching signal SW1.

The capacitor Cd is formed between the output terminal of the third compensating switching transistor Q3 and the control terminal of the driving transistor Qd.

The switching transistors Q4, Q5, and Q6 are amplifying switching transistors of the output buffer 540. The amplifying switching transistors Q4, Q5, and Q6 supply a data voltage Vdat to the driving transistor Qd, and amplify the data voltage Vdat to be applied to the data line $D_j$.

The first amplifying switching transistor Q4 has a control terminal, an input terminal, and an output terminal. The control terminal is connected to a terminal of the second switching signal SW2, the input terminal is connected to the terminal of the first voltage GVDD, and the output terminal is connected to the input terminal of the driving transistor Qd. The first amplifying switching transistor Q4 transmits the first voltage GVDD to the input terminal of the driving transistor Qd in accordance with the second switching signal SW2.

The second amplifying switching transistor Q5 has a control terminal connected to the terminal of the second switching signal SW2, an input terminal connected to an output terminal n1 of the digital-to-analog converter 530, and an output terminal connected to the capacitor Cd. The second amplifying switching transistor Q5 transmits a data voltage Vdat of the digital-to-analog converter 530 to the capacitor Cd in accordance with the second switching signal SW2.

The third amplifying switching transistor Q6 has a control terminal connected to the terminal of the second switching signal SW2, an input terminal connected to the output terminal of the driving transistor Qd, and an output terminal connected to the data line $D_j$. The third amplifying switching transistor Q6 connects the output terminal of the driving transistor Qd and the data line $D_j$ in accordance with the second switching signal SW2.

Switching transistor Q7 is a direct switching transistor of the output buffer 540. The direct switching transistor Q7 applies a data voltage Vdat directly to the data line $D_j$.

The direct switching transistor Q7 has a control terminal connected to the terminal of the third switching signal SW3, an input terminal connected to the output terminal n1 of the digital-to-analog converter 530, and an output terminal connected to the data line $D_j$. The direct switching transistor Q7 applies a data voltage Vdat of the digital-to-analog converter 530 directly to the data line $D_j$ in accordance with the third switching signal SW3, such that the data line $D_j$ is charged or discharged.

The first to third switching signals SW1, SW2, and SW3 may be supplied by the signal controller 600 of FIG. 1.

An exemplary operation of the output buffer 540 of FIG. 4 will now be further described with reference to FIGS. 5 to 6D.

Figure 5:
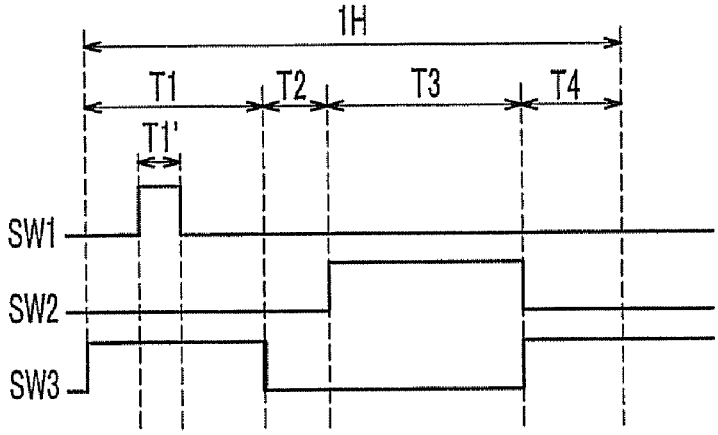
FIG. 5 is a signal waveform diagram illustrating an exemplary operation of the exemplary output buffer according to an exemplary embodiment of the present invention.

FIG. 5 is a signal waveform diagram illustrating an exemplary operation of the exemplary output buffer according to an exemplary embodiment of the present invention, and FIGS. 6A to 6D are equivalent circuit diagrams of the exemplary output buffer of FIG. 4 in each period of FIG. 5.

In a state in which the digital-to-analog converter 530 outputs a voltage through the output terminal n1, if the third switching signal SW3 becomes a turn-on voltage level that can turn on the direct switching transistor Q7, the first period T1 starts. At an initial state of the first period T1, the first and second switching signals SW1 and SW2 maintain a turn-off voltage level that can turn off the first, second, and third amplifying switching transistors Q4, Q5, and Q6, and the first, second, and third compensating switching transistors Q1, Q2, and Q3.

Figure 6A:
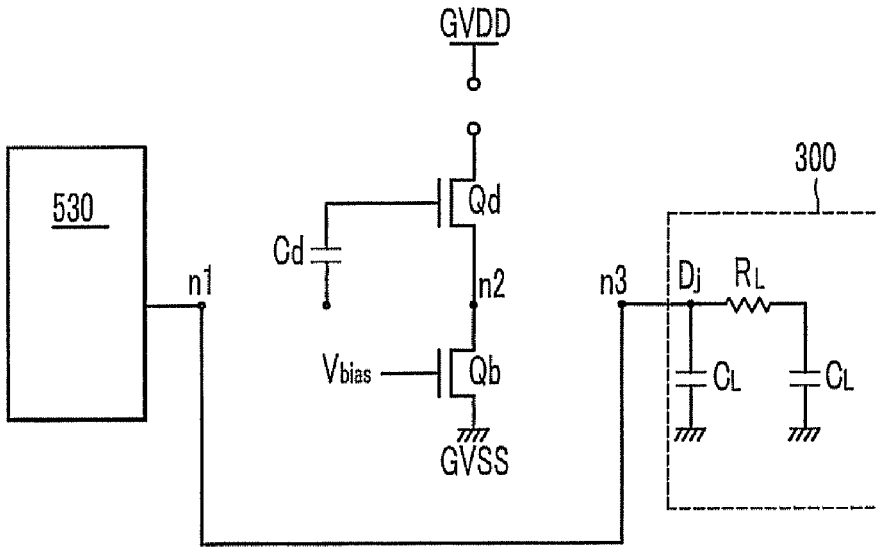
FIGS. 6A to 6D are equivalent circuit diagrams of the exemplary output buffer of FIG. 4 according to the signal waveform diagram of FIG. 5.

In the first period T1, the output buffer 540 can be represented by an equivalent circuit diagram shown in FIG. 6A.

Specifically, the direct switching transistor Q7 is turned on by the third switching signal SW3 applied to the control terminal of the direct switching transistor Q7, and thus the output terminal n1 of the digital-to-analog converter 530 is directly connected to the data line $D_j$.

If the output terminal n1 of the digital-to-analog converter 530 enters a floating state, a voltage at the output terminal n1 of the digital-to-analog converter 530 is equal to a target voltage to be applied to the data line $D_j$, and the target voltage corresponds to a data voltage Vdat. However, if the output terminal n1 of the digital-to-analog converter 530 is directly connected to the data line $D_j$, when the voltage of the data line $D_j$ is different from the data voltage Vdat, a voltage at the output terminal n1 of the digital-to-analog converter 530 may be temporarily different from the data voltage Vdat. Further, the voltage of the data line $D_j$ approaches the data voltage Vdat, and a path through which a voltage of a data line $D_j$ is charged or discharged becomes a resistor R string of the gray voltage generator 550.

Meanwhile, the amplifying switching transistors Q4, Q5, and Q6, and the compensating switching transistors Q1, Q2, and Q3 that are connected to the driving transistor Qd are turned off by the first and second switching signals SW1 and SW2 that maintain a turn-off voltage level that can turn off the first, second, and third amplifying switching transistors Q4, Q5, and Q6, and the first, second, and third compensating switching transistors Q1, Q2, and Q3. Thus, the driving transistor Qd is separated from the digital-to-analog converter 530 and the data line $D_j$.

The output buffer 540 has a compensating period T1' for compensating the threshold voltage Vth of the driving transistor Qd, and it is included within the first period T1.

During the compensating period T1', a voltage level of the first switching signal SW1 is shifted to a turn-on voltage level, and the first, second, and third compensating switching transistors Q1, Q2, and Q3 are turned on. During the compensating period T1', the output buffer 540 can be represented by an equivalent circuit diagram, as shown in FIG. 6B.

Figure 6B:
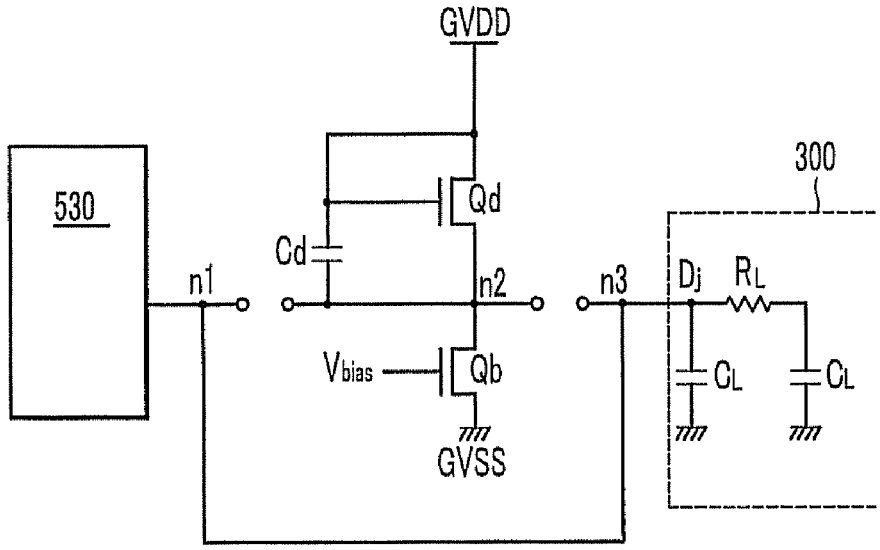

Referring to FIG. 6B, the input terminal and the output terminal of the driving transistor Qd are connected to each other, and they are also connected to the terminal of the first voltage GVDD. As a result, the driving transistor Qd is diode-connected.

A voltage Vn2 at the output terminal of the driving transistor Qd is determined as follows.

$$Vn2=Vg-Vth \quad \text{(Equation 1)}$$

In this case, Vg indicates a voltage of the control terminal (=voltage of the input terminal), and Vth indicates a threshold voltage of the driving transistor Qd.

Accordingly, the voltage difference (Vg−Vn2) between the control terminal and the output terminal of the driving transistor Qd is equal to the threshold voltage Vth of the driving transistor Qd. As a result, the threshold voltage Vth of the driving transistor Qd is charged in a capacitor Cd.

The compensating period T1' is maintained for a time in which a voltage charged in the capacitor Cd can be stabilized, and when the voltage level of the first switching signal SW1 is shifted again to a turn-off voltage level, the compensating period T1' is completed. Since the compensating period T1' occurs during the first period T1 in which the driving transistor Qd is spaced apart from the digital-to-analog converter 530 and the data line Dj, the compensating period T1' does not affect charging and discharging of the data line $D_j$.

Figure 6C:
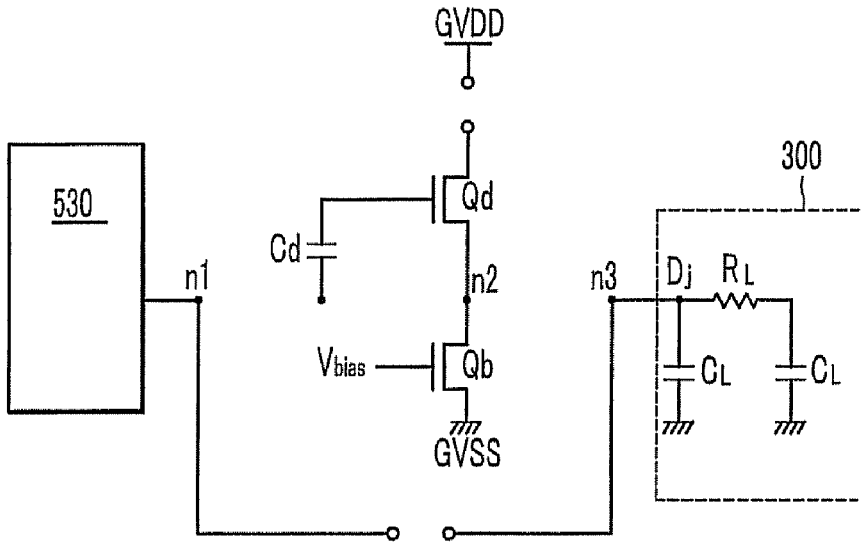

Then, as shown in FIG. 6C, in a state in which the first and second switching signals SW1 and SW2 maintain a turn-off voltage, if a voltage level of the third switching signal SW3 is also shifted to a turn-off voltage level, then the second period T2 starts.

In the second period T2, since all the first, second, and third switching signals SW1, SW2, and SW3 have a turn-off voltage level, the amplifying switching transistors Q4, Q5, and Q6, the direct switching transistor Q7, and the compensating switching transistors Q1, Q2, and Q3 are all turned off. Therefore, the connection state between the data line $D_j$, the output buffer 540, and the digital-to-analog converter 530 is released.

As such, if the output terminal n1 of the digital-to-analog converter 530 is separated from the data line $D_j$, the voltage of the output terminal n1 of the digital-to-analog converter 530 again becomes equal to the data voltage Vdat.

Then, in a state in which the first and third switching signals SW1 and SW3 remain turned off, if the voltage level of the second switching signal SW2 becomes shifted to a turn-on voltage level, the third period T3 starts.

Figure 6D:
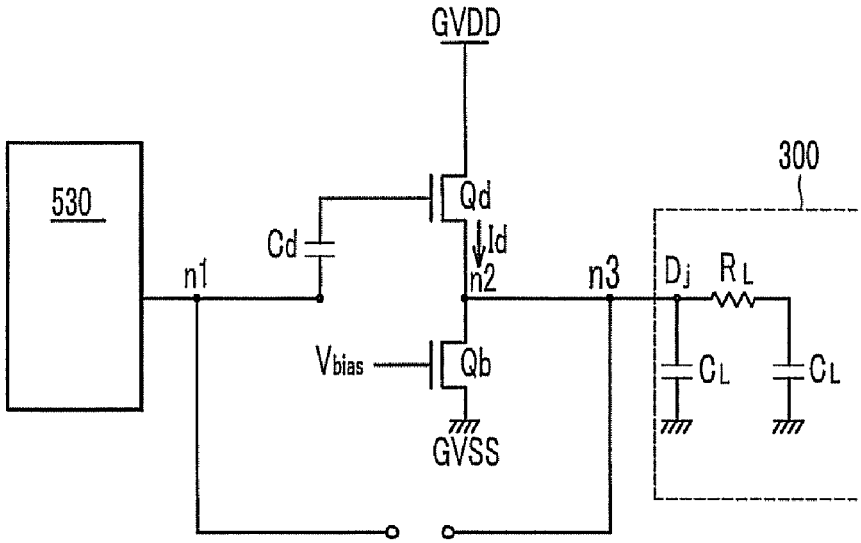

Referring to FIG. 6D, in accordance with the second switching signal SW2 having the turn-on voltage level, the first amplifying switching transistor Q4 is turned on, and thus the input terminal of the driving transistor Qd is connected to the first voltage GVDD. The second amplifying switching transistor Q5 is turned on, and thus the output terminal n1 of the digital-to-analog converter 530 is connected to the capacitor Cd. The third amplifying switching transistor Q6 is also turned on, and thus the output terminal of the driving transistor Qd is connected to the data line $D_j$.

Accordingly, through the second amplifying switching transistor Q5, the data voltage Vdat at the output terminal n1 of the digital-to-analog converter 530 is applied to one terminal of the capacitor Cd. The capacitor Cd maintains a threshold voltage Vth of the driving transistor Qd that is charging. Thus, a voltage Vg of the control terminal of the driving transistor Qd that is connected to the other terminal of the capacitor Cd is as follows.

$$Vg=Vdat+Vth \quad \text{(Equation 2)}$$

The driving transistor Qd flows an output current Id according to the voltage difference between the control terminal and the output terminal of the driving transistor Qd as follows.

$$Id=k\{Vgs-Vth\}^2 \quad \text{(Equation 3)}$$

In this case, k is a constant that is determined according to characteristics of the driving transistor Qd, and Vgs indicates the voltage difference between the control terminal and the output terminal of the driving transistor Qd.

Assuming that the output terminal voltage of the driving transistor Qd, that is, the voltage of the data line $D_j$, is Vn3, if Equation 2 is substituted for Equation 3, the following Equation 4 is produced.

$$Id/k=\{(Vdat+Vth-Vn3)-Vth\}^2 \quad \text{(Equation 4)}$$

The voltage Vn3 of the data line D1 is as follows.

$$Vn3=Vdat+\alpha \quad \text{(Equation 5)}$$

In this case, $\alpha=-(Id/k)^{1/2}$. In a steady state, since an output current Id is constant, $\alpha$ is also constant.

Accordingly, a level of the voltage Vn3 of the data line Dj becomes different from a level of the data voltage Vdat by $\alpha$. The value $\alpha$ can be determined through experiments, and in this case it is preferable that a be substantially 0.

In this way, in the third period T3, the driving transistor Qd quickly charges the data line Dj.

Finally, while the first switching signal SW is maintained in a turn-off state, the voltage level of the second switching signal SW2 is shifted to a turn-off voltage level. If the voltage level of the third switching signal SW3 is shifted to a turn-on voltage level, the fourth period T4 starts.

In the fourth period T4, the output buffer 540 has a connection relationship shown in FIG. 6A. That is, as in the first period T1, the driving transistor Qd is disconnected from the digital-to-analog converter 530 and the data line $D_j$. The direct switching transistor Q7 is turned on, and thus the output terminal nil of the digital-to-analog converter 530 is again directly connected to the data line $D_j$.

In the third period T3, if the data voltage Vdat is smaller than a previous data voltage, a charge in the data line Dj is made to flow through the bias transistor Qb until the voltage Vn3 of the data line $D_j$ has a voltage level represented in Equation 5. However, the discharging of the data line $D_j$ occurs later than the charging of the data line $D_j$. Thus, in the fourth period T4, the data line $D_j$ and the output terminal n1 of the digital-to-analog converter 530 may be directly connected to each other, and a remaining charge may be discharged through a resistor R string of the gray voltage generator 550.

In this way, the voltage Vn3 of the data line $D_j$ applied through the driving transistor Qd becomes equal to the data voltage Vdat output by the digital-to-analog converter 530.

The output buffer 540 according to the exemplary embodiment of the present invention progresses through the first to fourth periods T1 to T4 for one horizontal period (1H), and a maintaining time of each period can be optimally determined through experiments.

Figures 7, 8:
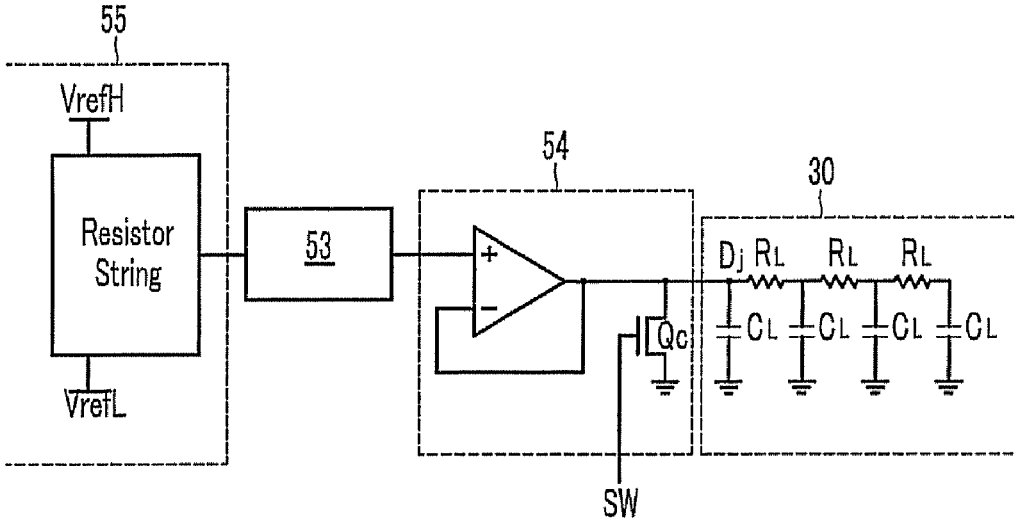
FIG.7 PRIOR ART
FIG. 7 is a block diagram of an output buffer according to a comparative example of an exemplary embodiment of the present invention; and, FIG. 8 is a table illustrating a comparison between power consumption in an output buffer according to the comparative example of FIG. 7 and power consumption of the exemplary output buffer according to an exemplary embodiment of the present invention.

FIG. 7 is a block diagram illustrating a display device including an output buffer according to a comparative example of the present invention, and FIG. 8 is a table illustrating a comparison between power consumption in the gray voltage generator and the output buffer of FIG. 7 and power consumption in the exemplary gray voltage generator and the exemplary output buffer of FIG. 4.

Referring to FIG. 7, the display device according to the comparative example of the present invention includes a gray voltage generator 55, a digital-to-analog converter 53, and an output buffer 54 that is connected to the data line $D_j$ formed in a liquid crystal panel assembly 30.

The gray voltage generator 55 has a resistor string that is connected in series to a terminal of a high-level gray reference voltage VrefH and a terminal of a low-level gray reference voltage VrefL.

The output buffer 54 has an amplifier that performs a buffering operation, and transmits a data voltage of the digital-to-analog converter 53 to the data line $D_j$ and maintains it for a predetermined time.

The output buffer 54 further includes a discharge transistor Qc for discharging the data line $D_j$. The discharge transistor Qc has a control terminal connected to a terminal of a switching signal sw, an input terminal connected to the data line $D_j$, and an output terminal connected to a terminal of a low-level voltage. The discharge transistor Qc is turned on/off according to the switching signal sw, and discharges a charge charged in the data line $D_j$ to the terminal of the low-level voltage.

Referring to FIG. 8, in the present exemplary embodiment, power consumption in the gray voltage generator 550 is larger than that of the comparative example by 1.670 mW, but power consumption in the output buffer 540 is smaller than that of the comparative example by 6.852 mW. The difference between power consumption between the exemplary embodiment and the comparative example occurs for the following reasons. In the present exemplary embodiment, since the gray voltage generator 550 becomes a path through which the voltage of the data line is discharged, power consumption in the gray voltage generator 550 is increased, but power consumption in the output buffer 540 is decreased so as to compensate for the increased power consumption.

Therefore, although the amplifier for discharge is not provided as in the output buffer 54 of the comparative example, charging and discharging operations can be performed in the exemplary embodiment while reducing unnecessary power consumption.

The output buffer 540 of the data driver 500 may also be used as an output buffer of another display device that includes a gray voltage generator 550 having a resistor R string, and a digital-to-analog converter 530 having switching elements. For example, an organic light emitting display ("OLED") that has a driving circuit similar to that of the LCD may include a data driver 500 having the output buffer 540 according to the exemplary embodiments of the present invention.

As such, according to the exemplary embodiments of the present invention, when a data voltage is charged or discharged in the data line, a separate transistor for discharge or a separate amplifier for discharge is not used. Accordingly, an area of the data driver can be reduced while reducing power consumption.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving device for a display device, the display device including a plurality of pixels connected to data lines, the driving device comprising:

a gray voltage generator which generates a plurality of gray voltages;

a voltage selector which selects an output voltage from the plurality of gray voltages;

a voltage level converter which converts a level of the output voltage selected by the voltage selector and applies the output voltage with a converted level to the data lines;

a first switching unit connecting the voltage level converter to the voltage selector and the data lines; and a second switching unit directly connecting the voltage selector and the data lines, wherein operating times of the first switching unit and the second switching unit are different from each other, wherein the first switching unit comprises a first switching transistor connecting the voltage level converter to the voltage selector, a second switching transistor connecting the voltage level converter to the data lines, and a third switching transistor connecting the voltage level converter to a first voltage terminal having a first voltage and wherein a control terminal of the first switching transistor, a control terminal of the second switching transistor, and a control terminal of the third switching transistor are electrically connected to each other by a direct connection; and the connection of the control terminal of the first switching transistor, the control terminal of the second switching transistor, and the control terminal of the third switching transistor is not connected to a capacitor.

2. The driving device of claim 1, wherein the voltage selector determines the output voltage based on input image data.

3. The driving device of claim 2, wherein the voltage selector comprises a digital-to-analog converter.

4. The driving device of claim 1, wherein the second switching unit comprises a transistor that has input and output terminals connected to the voltage selector and at least one of the data lines.

5. The driving device of claim 4, wherein the transistor of the second switching unit is a direct switching transistor with the input terminal connected to an output terminal of the voltage selector and the output terminal of the direct switching transistor connected to the at least one of the data lines.

6. The driving device of claim 1, wherein the voltage level converter comprises a driving transistor including a control terminal, an input terminal, and an output terminal, wherein the control terminal of the driving transistor is electrically connected to the first switching transistor, and the output terminal of the driving transistor is connected to the second switching transistor.

7. The driving device of claim 6, wherein the third switching transistor connects the input terminal of the driving transistor to the first voltage terminal.

8. The driving device of claim 7, wherein the voltage level converter further comprises a bias transistor connected to the output terminal of the driving transistor and connected to a second voltage terminal having a second voltage that is smaller than the first voltage.

9. The driving device of claim 6, further comprising a threshold voltage compensating unit which compensates a threshold voltage of the driving transistor.

10. The driving device of claim 9, wherein the threshold voltage compensating unit operates when the first switching unit is turned off.

11. The driving device of claim 10, wherein the second switching unit is turned on during operation of the threshold voltage compensating unit, and operation of the threshold voltage compensating unit does not affect charging and discharging of the data lines.

12. The driving device of claim 9, wherein the threshold voltage compensating unit comprises:

a capacitor connected between the control terminal of the driving transistor and the first switching transistor;

a first compensating transistor connected to the input terminal of the driving transistor and a first voltage terminal having a first voltage;

a second compensating transistor connected to the input terminal and the output terminal of the driving transistor; and a third compensating transistor connected between the capacitor and first switching transistor, and the output terminal of the driving transistor.

13. The driving device of claim 12, wherein the operation of the threshold voltage compensating unit is maintained for a time in which a voltage charged in the capacitor is stabilized.

14. The driving device of claim 1, wherein the voltage level converter does not include an amplifier for applying the output voltage from the voltage selector to the data lines.

15. A display device comprising:

a plurality of pixels connected to data lines;

a gray voltage generator which generates a plurality of gray voltages;

a gate driver which applies a gate signal to gate lines; and a data driver which processes a voltage selected from the plurality of gray voltages, generates an output voltage, and applies the output voltage to the data lines, wherein the data driver has an output buffer which charges and discharges the data lines according to the output voltage, wherein the output buffer comprises a second switching transistor connected to a first voltage terminal having a first voltage, a third switching transistor which receives the voltage selected from the plurality of gray voltages, and a fourth switching transistor which outputs the output voltage, and wherein a control terminal of the second switching transistor, a control terminal of the third switching transistor, and a control terminal of the fourth switching transistor are electrically connected to each other by a direct connection; and the connection of the control terminal of the second switching transistor, the control terminal of the third switching transistor, and the control terminal of the fourth switching transistor is not connected to a capacitor.

16. The display device of claim 15, wherein the data driver further comprises a digital-to-analog converter which converts digital image data into a data voltage selected from the gray voltages and supplies the data voltage to the output buffer.

17. The display device of claim 16, wherein the output buffer comprises:

a driving transistor which processes the data voltage and outputs processed data voltage as the output voltage, in a first period; and a first switching transistor which directly connects a voltage of the data voltage to a data line, in a second period that is different from the first period.

18. The display device of claim 17, wherein the second switching transistor connecting the first voltage terminal to an input terminal of the driving transistor, in the first period;

wherein the third switching transistor electrically connects a terminal of the data voltage to a control terminal of the driving transistor, in the first period; and wherein the fourth switching transistor connects an output terminal of the driving transistor to a data line, in the first period.

19. The display device of claim 18, wherein the output buffer further comprises:

a capacitor which charges a voltage between the control terminal and the output terminal of the driving transistor, in a third period that is different from the first period;

a first compensating transistor connecting the first voltage terminal to the input terminal of the driving transistor, in the third period;

a second compensating transistor connecting the input terminal and the control terminal of the driving transistor, in the third period; and a third compensating transistor connecting the capacitor and the output terminal of the driving transistor, in the third period.

20. The display device of claim 19, wherein the third switching transistor connects the terminal of the data voltage to the control terminal of the driving transistor through the capacitor.

21. The display device of claim 20, wherein the third period is included in the second period.

22. The display device of claim 20, wherein the output buffer further comprises a bias transistor connected to the output terminal of the driving transistor and the second voltage, and allows an output current of the driving transistor to flow in accordance with a bias voltage.

23. A method of driving a display device, the method comprising:

converting a digital image signal into an analog data voltage;

connecting a terminal of the analog data voltage to data lines of the display device;

generating a conversion voltage based on the analog data voltage; and connecting a terminal of the conversion voltage to the data lines, wherein the analog data voltage is received through a first switching transistor and the conversion voltage is outputted through a second switching transistor, and wherein a control terminal of the first switching transistor, a control terminal of the second switching transistor, and a control terminal of a third switching transistor are electrically connected to each other by a direct connection, the third switching transistor is connected to a first voltage terminal having a first voltage, and a fourth switching transistor directly connects the analog data voltage and the data lines; and the connection of the control terminal of the first switching transistor, the control terminal of the second switching transistor, and the control terminal of the third switching transistor is not connected to a capacitor.

24. The method of claim 23, wherein connecting the terminal of the analog data voltage directly to the data lines is performed before or after connecting the terminal of the conversion voltage to the data lines.

25. The method of claim 24, further comprising compensating a threshold voltage of a driving transistor, wherein the conversion voltage is generated by the driving transistor.

26. The method of claim 25, wherein compensating the threshold voltage of the driving transistor is performed in a state in which the terminal of the analog data voltage is directly connected to the data lines.

27. The method of claim 26, further comprising disconnecting the terminal of the analog data voltage and the data lines from each other before generating the conversion voltage.

* * * * *